US005873605A

United States Patent [19]

Kaplan

[11] Patent Number: 5,873,605

[45] Date of Patent: Feb. 23, 1999

[54] PERSONALIZED POSTAL STAMP

[76] Inventor: Kenneth Kaplan, 104 Teatown Rd., Croton on Hudson, N.Y. 10520

[21] Appl. No.: 786,280

[22] Filed: Jan. 22, 1997

[51] Int. Cl.[6] ..... G09F 3/00

[52] U.S. Cl. ..... 283/71

[58] Field of Search ..... 283/67, 70, 71, 283/77, 51

[56] References Cited

U.S. PATENT DOCUMENTS

| | | | |
|---|---|---|---|
| 4,715,622 | 12/1987 | Mikhail | 285/71 |
| 4,999,065 | 3/1991 | Wilfert | 283/77 |
| 5,296,279 | 3/1994 | Birnbaum et al. | 285/71 X |

*Primary Examiner*—Willmon Fridie, Jr.
*Attorney, Agent, or Firm*—Amster, Rothstein & Ebenstein

[57] ABSTRACT

A personalized postal stamp has on a back surface thereof an adhesive layer for adhering the stamp to a letter or postal card, and on a front surface thereof first and second regions. The first region presents an image of indicia qualifying the stamp as a lawful stamp of a given postage denomination, and the second region, which is substantially disposed within the first region, presents an image of a person who purchased the stamp from a vending machine. The front surface is of unitary, one-piece and integral construction. The first and second region images are formed either simultaneously in a single operation or at different times by different operations.

6 Claims, 1 Drawing Sheet

FIG. 1
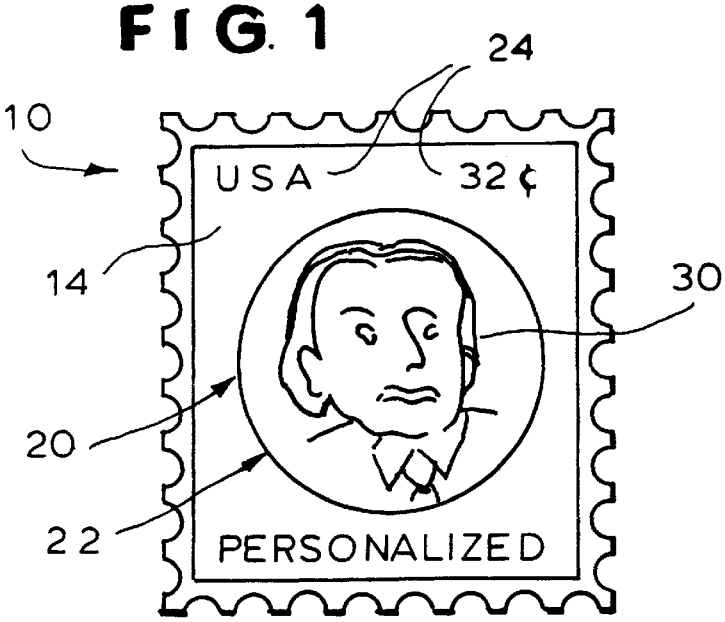
FIG. 2
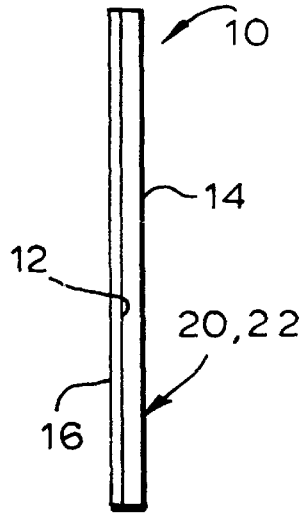
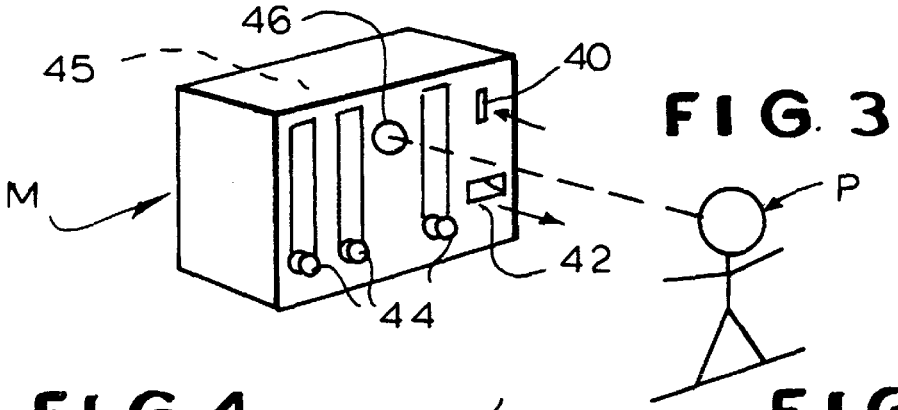
FIG. 3
FIG. 4
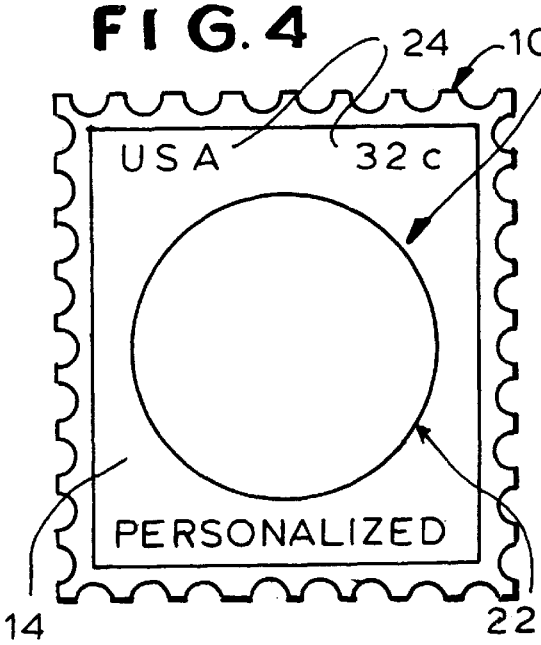
FIG. 5
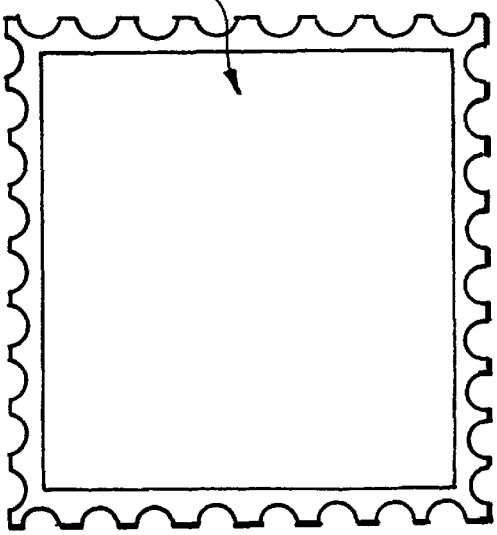

PERSONALIZED POSTAL STAMP

BACKGROUND OF THE INVENTION

The present invention relates to a personalized postal stamp and a method of making the same, and more particularly to such a stamp and method wherein the front surface of the stamp is of unitary, one-piece and integral construction for acceptability to the Postal Service.

The desirability of a personalized postal stamp—that is, a stamp bearing on the front surface thereof both the indicia qualifying the stamp as a lawful stamp of a given postage denomination and an image of a person who was in a predetermined spatial relationship to a vending machine at the time the stamp was purchased—is well known and has resulted in several patents relating thereto. Notwithstanding the flurry of past inventive concepts that were deemed worthy of the issue of a U.S. patent thereon, to the best of Applicant's knowledge neither the U.S. Post Office nor the U.S. Postal Service (i.e., the U.S. Postal Authorities) has ever authorized such a personalized postal stamp for use in the postal system.

For the most part, the pertinent prior art inventive concepts involved providing on the front surface of the stamp a first region presenting an image of indicia qualifying the stamp as a lawful stamp of a given postage denomination, and a second blank region substantially disposed within the first region, and further involved providing photographs of an individual, suitably cropped to fit within the second region. The stamp contains on the back surface an adhesive layer for adhering the stamp to a letter or postal card. Either the photograph includes on the back surface an adhesive layer for adhering the photograph on the second region, or the user of the stamp is intended to apply an adhesive layer between the photograph and the second region so as to secure together the back surface of the photograph and the front surface of the second region. See, for example, U.S. Pat. No. 5,423,573, which describes both regions as having adhesive backs so that the decorated design or photograph may be adhered to the front face of the stamp and the stamp adhered to the letter or postal card.

It is the belief of the inventor that the primary reason the aforementioned prior art inventive concepts have not materialized is because the postal authorities would not accept a stamp having an adhesively affixed photograph thereon because it might interfere with or otherwise render unreliable the stamp cancellation process. A stamp is generally of a relatively small size, and the photograph would preferably be designed to occupy a major portion of the stamp so that the photographic image would be recognizable. Typically a stamp is cancelled by receiving a cancellation imprint over the stamp. The cancellation imprint may simply be a series of parallel wavy lines extending over at least some portion of the stamp and optionally at least some portion of the letter or postal card thereabout. To the extent that the cancellation imprint was substantially contained on the photograph, in the inventive concepts discussed above the photograph (and therefore substantially all of the cancellation imprint) could be removed from the used stamp and the stamp then reused. Alternatively, in the same situation a second photograph could be adhered to a used stamp (over the first photograph) to conceal the cancellation imprint, and the stamp then reused. Reuse of the stamp could be either without any photograph or with a replacement photograph. In both instances, at least a substantial portion of the cancellation imprint would be either removed or concealed, thus possibly enabling unlawful reuse of the stamp without detection.

Accordingly, it is an object of the present invention to provide a personalized postage stamp which may be more acceptable to the postal authorities than the prior art personalized postage stamp concepts.

Another object is to provide such a stamp which would not lend itself to unlawful reuse after receipt of a cancellation imprint.

A further object is to provide a method of making such a stamp.

It is also an object of the present invention to provide a vending machine for making and selling such a stamp.

SUMMARY OF THE INVENTION

It has now been found that the above and related objects of the present invention are obtained in a personalized postal stamp comprising a stamp having a back surface and a front surface. On the back surface thereof is an adhesive layer for adhering the stamp to a letter or postal card. On the front surface thereof are first and second regions. The first region presents an image of indicia qualifying the stamp as a lawful stamp of a given postage denomination, and the second region, which is substantially disposed within the first region, presents an image of a person present when the stamp is purchased from a vending machine. The front surface is of unitary, one-piece and integral construction.

The first and second region images may be formed simultaneously in a single operation or formed at different times by different operations.

The present invention also encompasses a method of making a personalized postal stamp comprising the steps of providing a stamp having on a back surface thereof an adhesive layer for adhering the stamp to a letter or postal card and on a front surface thereof a first region presenting an image of indicia qualifying the stamp as a lawful stamp of a given postage denomination. The next step is forming in real time, on the front surface in a second region substantially disposed within the first region, an image of a person in fixed spatial relationship to a vending machine at the time of purchase of the stamp therefrom. The front surface is of unitary, one-piece and integral construction. Preferably the method includes the additional step of providing a vending machine for making and selling personalized postal stamps, the vending machine being constructed to cause the image of the person to be formed in the second region of the front surface of the stamp being purchased.

Alternatively, the method of making a personalized postal stamp comprises the steps of providing an inchoate stamp having on a back surface thereof an adhesive layer for adhering the stamp to a letter or postal card. The next step is forming in real time on the front surface of the stamp a first region presenting an image of indicia qualifying the stamp as a lawful stamp of a given postage denomination and a second region, substantially disposed within the first region, presenting an image of a person in fixed spatial relationship to the vending machine at the time of purchase of the stamp therefrom. The front surface is of unitary, one-piece and integral construction. Preferably the method includes the additional steps of providing a vending machine for making and selling personalized postal stamps, the vending machine being constructed to cause the indicia image to be formed in the first region of the front surface of the stamp being purchased, and the person image to be formed in the second region of the front surface of the stamp being purchased.

BRIEF DESCRIPTION OF THE DRAWING

The above and related objects, advantages and features of the present invention will be more fully understood by reference to the following detailed description of the presently preferred, albeit illustrative, embodiments of the present invention when taken in conjunction with the accompanying drawing wherein:

FIG. 1 is a front elevational view of a stamp according to the present invention;

FIG. 2 is a side elevational view thereof;

FIG. 3 is an isometric view of a person purchasing stamps from a vending machine constructed to form stamps of the present invention;

FIG. 4 is a front elevational view of a stamp prior to impressment of the person image in the second region; and FIG. 5 is a front elevational view of a stamp prior to impressment of any image thereon.

DETAILED DESCRIPTION OF THE PREFERRED EMBODIMENTS

Referring now to the drawing, and in particular to FIGS. 1 and 2 thereof, therein illustrated is a personalized postal stamp according to the present invention, generally designated by the reference numeral 10. The stamp 10 has a back surface 12 and a front surface 14. As in a conventional postal stamp, the back surface 12 has an adhesive layer 16 for adhering the stamp to a letter or postal card (not shown). The adhesive layer may require moistening for activation, or it may be a pressure-sensitive adhesive which does not require any moistening for activation. In the latter case, the exposed surface of the adhesive layer would typically be covered by a release paper until it is about to be applied to the letter or postal card.

The front surface 14 of the stamp 10 defines a first region, generally designated 20, and a second region, generally designated 22. The first region preferably occupies an outer margin of the stamp 10 and substantially surrounds the second region 22. The first region 20 presents an image 24 of indicia qualifying the stamp 10 as a lawful stamp of a given postage denomination. As illustrated in FIG. 1, the country of issue (U.S.A.) and the denomination (32¢) occupies the top margin of the first region 20, although various other indicia, whether in color or black and white, may also be disposed in the first region 20—for example, to facilitate the detection of counterfeiting, alterations and the like. As similar indicia are common to U.S. postage stamps, further details thereof need not be set forth herein.

The second region 22, as earlier noted, is substantially disposed within the first region 20 and surrounded thereby, although for particular applications it may also border on one or more of the peripheral edges of the first region 20 and thus not be entirely surrounded thereby. The second region 22 presents an image 30 of a person. The image 30 may be of the person who purchased the stamp from a vending machine, or a third party who happened to be situated on a spot in a fixed spatial relationship to the vending machine at the appropriate time (perhaps when a red light indicates that the image of the person in a designated spot is being taken). For our purposes, it may be assumed that the person who purchases the stamp will be the person standing in that spot, although possibly one person may be purchasing the stamp and having another person stand in the designated spot so that it is the other person's image 30 which is formed on the second region 22. While the image 30 is illustrated in FIG. 1 as a face of the person, clearly the entire person or other particular portions of the anatomy could be imaged. As the size of the image is strictly limited, typically the image 30 will be of a face.

It is a critical feature of the present invention that the front surface 14 is of unitary, one-piece and integral construction. Thus, precisely because the front surface is of unitary, one-piece and integral construction, the portion of the cancellation imprint eventually placed on the image 30 in the second region 22 cannot be removed from the remainder of the stamp front surface 14 because the image 30 is a part of that front surface 14. Similarly, because the image 30 on the second region 22 is actually formed on the front surface 14 of the stamp 10 and is not merely adhered thereto, it does not appreciably increase the thickness thereof. Thus, any covering of the cancellation imprint on the second region 22 by adhering something thereover would be clearly evident as an improper thickening of the stamp in the area of the second region 22.

As will be described in further detail hereinbelow, the images 24, 30 of the first and second regions 20, 22, respectively, may be formed simultaneously in a single operation or may be formed at different times by different operations. In the former instance, the inchoate or as yet unformed stamp 50 (see FIG. 5) has a blank front face 14 on which the images 24, 30 of the first and second regions 20, 22 are simultaneously created in a single operation. In the latter instance, a stamp having a complete image 20 in the first region 20 may be pre-formed, as in FIG. 4, and stored in the vending machine. Subsequently, upon purchase of a stamp, the image 30 is created in the second region 22.

Thus the personalized postal stamp 10 according to the present invention may be made by providing a stamp 10', as illustrated in FIG. 4, having on a back surface 12 thereof an adhesive layer 16 for adhering the stamp to a letter or postal card, and on a front surface 14 thereof a first region 20 presenting an image of indicia 24 qualifying the stamp as a lawful stamp of a given postage denomination. Then, according to this first method, there is formed, in real time, on the front surface 14 in a second region 22 substantially disposed within the first region 20, an image 30 of a person P in fixed spatial relationship to a vending machine M at the time of purchase of the stamp therefrom (as illustrated in FIG. 3). Thus this method preferably includes the additional step of providing a vending machine M for making and selling personalized postal stamps 10. The vending machine M is constructed to cause the image 30 of the person P in fixed spatial relationship thereto to be formed in the second region 22 of the front surface 14 of the stamp 10 being purchased.

In an alternative or second method of making a personalized postal stamp according to the present invention, an inchoate stamp 50 (see FIG. 5) is provided, the stamp having on a back surface 12 thereof an adhesive layer 16 for adhering the stamp to a letter or postal card. Then there is formed in real time on the front surface 14 of the inchoate stamp 50 a first region 20 presenting an image of indicia 24 qualifying the stamp as a lawful stamp of a given postage denomination, and a second region 22 substantially disposed within the first region 20 and presenting an image of a person P in fixed spatial relationship to the vending machine M at generally the time of purchase of the stamp therefrom. Thus, this alternative method preferably includes the additional step of providing a vending machine M for making and selling personalized postal stamps 10. The machine is constructed to cause the image of indicia 24 to be formed in the first region 20 and the image 30 of the person P to be formed in the second region 22.

It will be appreciated that a vending machine according to the present invention may easily be constructed from off-the-shelf components presently in commercial use. Thus the machine M would be similar to a conventional stamp-dispensing machine including a money receptacle 40 (for receiving money), a stamp dispenser (for dispensing stamps) 42, and various knobs 44 which may be actuated to indicate the appropriate denomination and/or number of stamps to be dispensed. The other component would be a conventional computer system 45 including a TV-camera-like input device or eye 46 and a printer-like output device such that an image of a person P in a predetermined spatial relationship to the eye 46 of the dispensing machine M (e.g., the eye of the person P facing the eye 46 of the machine M) would have the image of his face imprinted in second region 22 of the stamp 10. The stamp 10 may be pre-printed with the qualifying indicia image 24 in the first region 20 (as illustrated in FIG. 4), or the camera may see a composite of the person P and the indicia 24 appropriately positioned thereabout so that the entire front face 14 of the inchoate stamp 50 is printed at once.

To summarize, the present invention provides a personalized postage stamp which may be more acceptable to the postal authorities than the prior art personalized postage stamp concepts because it would not lend itself to unlawful reuse after receipt of a cancellation imprint. The present invention further provides a method of making such a stamp and a vending machine for making and selling such a stamp.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A method of making a personalized postal stamp comprising the steps of:

(A) providing a stamp having on a back surface thereof an adhesive layer for adhering the stamp to a letter or postal card and on a front surface thereof a first region presenting an image of indicia qualifying the stamp as a lawful stamp of a given postage denomination; and (B) forming in real time, on the front surface in a second region substantially disposed within the first region, an image of a person in fixed spatial relationship to a vending machine at the time of purchase of the stamp therefrom, the front surface being of unitary, one-piece and integral construction.

2. The method of claim 1 wherein the first and second region images are formed simultaneously in a single operation.

3. The method of claim 1 wherein the first and second region images are formed at different times by different operations.

4. The method of claim 1 including the additional step of providing a vending machine for making and selling personalized postal stamps, the vending machine being constructed to cause the image of the person to be formed in the second region of the front surface of the stamp being purchased.

5. A method of making a personalized postal stamp comprising the steps of:

(A) providing an inchoate stamp having on a back surface thereof an adhesive layer for adhering the stamp to a letter or postal card; and (B) forming in real time on the front surface of the stamp a first region presenting an image of indicia qualifying the stamp as a lawful stamp of a given postage denomination and a second region substantially disposed within the first region and presenting an image of a person in fixed spatial relationship to a vending machine at the time of purchase of the stamp therefrom, the front surface being of unitary, one-piece and integral construction.

6. The method of claim 5 including the additional steps of providing a vending machine for personalized postal stamps, the vending machine being constructed to cause (i) the image of indicia qualifying the stamp as a lawful stamp of a given postage denomination to be formed in the first region of the front surface of the stamp being purchased, and (ii) the image of the person to be formed in the second region of the front surface of the stamp being purchased.

* * * * *